US008056573B2

(12) United States Patent
Panigot

(10) Patent No.: US 8,056,573 B2
(45) Date of Patent: Nov. 15, 2011

(54) FREESTANDING COLLAPSIBLE SHELTER

(75) Inventor: Joseph E. Panigot, Germantown, MD (US)

(73) Assignee: Foldable Stuff, LLC, Germantown, MD (US)

( * ) Notice: Subject to any disclaimer, the term of this patent is extended or adjusted under 35 U.S.C. 154(b) by 210 days.

(21) Appl. No.: 12/401,768

(22) Filed: Mar. 11, 2009

(65) Prior Publication Data

US 2010/0229907 A1 Sep. 16, 2010

(51) Int. Cl.
*E04H 15/48* (2006.01)
*E04B 1/32* (2006.01)

(52) U.S. Cl. ..... 135/147; 135/144; 135/153; 52/641; 52/646

(58) Field of Classification Search ..... 135/143, 135/144, 146, 147, 156, 153
See application file for complete search history.

(56) References Cited

U.S. PATENT DOCUMENTS

| | | | | |
|---|---|---|---|---|
| 1,335,456 | A * | 3/1920 | Nelson | 5/113 |
| 1,449,894 | A | 3/1923 | Dial | |
| 2,723,673 | A * | 11/1955 | Call | 135/140 |
| 3,221,756 | A * | 12/1965 | Rupright | 135/98 |
| 3,599,651 | A | 8/1971 | Perry | |
| 4,033,366 | A | 7/1977 | Forget | |
| 4,074,682 | A | 2/1978 | Yoon | |
| 4,170,852 | A | 10/1979 | Danis, Jr. | |
| 4,202,363 | A | 5/1980 | Watts et al. | |
| 4,256,300 | A * | 3/1981 | Boucher | 472/118 |
| 4,606,366 | A | 8/1986 | Collet | |
| 4,811,437 | A | 3/1989 | Dillner et al. | |
| 4,966,178 | A | 10/1990 | Eichhorn | |
| 4,971,090 | A | 11/1990 | Uhl | |
| 4,998,552 | A | 3/1991 | Niksic et al. | |
| 5,333,634 | A | 8/1994 | Taylor | |
| 5,697,111 | A | 12/1997 | Dillner et al. | |
| 5,771,651 | A * | 6/1998 | Shiina | 52/641 |
| 5,819,342 | A | 10/1998 | Williams | |
| 5,904,344 | A | 5/1999 | Pope et al. | |
| 5,915,400 | A | 6/1999 | Pohl et al. | |
| 5,944,040 | A | 8/1999 | Jang | |
| 6,021,795 | A | 2/2000 | Long et al. | |
| 6,152,157 | A | 11/2000 | Jang | |
| 6,173,726 | B1 | 1/2001 | Talmadge | |
| 6,199,572 | B1 | 3/2001 | Rousselle et al. | |
| 6,253,498 | B1 | 7/2001 | Fanucci | |
| 6,273,115 | B1 | 8/2001 | Guggisberg | |
| 6,421,850 | B1 | 7/2002 | Welsh, Jr. | |
| 6,434,895 | B1 | 8/2002 | Hosterman et al. | |
| 6,634,152 | B1 | 10/2003 | Pilkinton | |
| 6,748,962 | B2 | 6/2004 | Miller | |
| 6,763,633 | B2 | 7/2004 | Cote | |

(Continued)

FOREIGN PATENT DOCUMENTS

| | | |
|---|---|---|
| WO | 8204383 | 12/1982 |

(Continued)

*Primary Examiner* — David Dunn
*Assistant Examiner* — Danielle Jackson
(74) *Attorney, Agent, or Firm* — Edell, Shapiro & Finnan, LLC

(57) ABSTRACT

A freestanding, collapsible shelter is disclosed. The shelter includes a roof structure having a roof hub, a ridge poles pivotable from a deployed position to a stowed position, gable poles pivotable from a deployed position to a stowed position. The shelter further includes a freestanding leg section that supports the roof structure over a supporting surface when the shelter is disposed in its deployed position. The shelter may also include a canopy.

26 Claims, 15 Drawing Sheets

U.S. PATENT DOCUMENTS

| | | | | |
|---|---|---|---|---|
| 6,892,744 | B2 | 5/2005 | Feldpausch et al. | |
| 7,025,075 | B2 | 4/2006 | Suh | |
| 7,290,553 | B2 | 11/2007 | Prevost | |
| 7,299,812 | B2 | 11/2007 | Carter | |
| 7,316,239 | B2 | 1/2008 | Yang | |
| 2005/0126617 | A1 | 6/2005 | Holub | |
| 2007/0051399 | A1 * | 3/2007 | Jung | 135/135 |
| 2007/0095376 | A1 | 5/2007 | Rottmann | |
| 2007/0175504 | A1 | 8/2007 | Tseng | |
| 2007/0215193 | A1 | 9/2007 | Flores | |
| 2008/0083189 | A1 | 4/2008 | Dulac | |

FOREIGN PATENT DOCUMENTS

| | | | |
|---|---|---|---|
| WO | 2007123314 | A1 | 11/2007 |

* cited by examiner

FREESTANDING COLLAPSIBLE SHELTER

FIELD OF THE INVENTION

This invention is directed toward a collapsible freestanding shelter and, in particular, toward a freestanding shelter having a gabled or double pitched roof canopy when deployed.

BACKGROUND OF THE INVENTION

Freestanding collapsible shelters, shelters that, when fully deployed, can stand upright on their own without being attached to an object that anchors the shelter in place, are often used in recreational settings to obtain relief from the sun and/or weather. Typically, such shelters have some type of framing that, when deployed, configures a canopy that provides the protection sought. Some important considerations for these shelters is their ability to be deployed quickly, as well as their being lightweight and compact when collapsed.

One type of such shelter relies on pole segments that are strung together by elastic cords running through channels in the poles to serve as its framing. The segments in each pole alternate between those that have sleeves at each end and those that do not. To deploy the shelter, the poles are first assembled by inserting the ends of the sleeveless poles into the sleeves on the subsequent poles. The elasticity of the cords running through the pole segments hold the segments together during assembly. Once the poles are assembled, they are inserted through sleeves located in the top portion of the shelter canopy. Each end of a pole protruding from its respective sleeve is then forced into a pocket located on the bottom corner or side edge of the shelter. Once each end of a pole is tucked into its corresponding pocket, the pole bows and the resulting tension of each pole against its respective sleeve forces the overall frame to maintain an upright position, forming the configuration of the deployed shelter.

This type of shelter has several disadvantages. First, deploying this type of shelter can be a time consuming process that typically requires setup via two people instead of one. Second, should the cords be cut or come apart, the tent or shelter cannot be assembled. Also, over time, the cords gradually lose their elasticity so that the pole segments are not held together as well. These shelters typically also have a dome shaped-canopy, which limits the amount of available head space compared to a gabled or double pitched canopy. Because a dome-shaped canopy provides a circular- or oval-shaped area of protection underneath the canopy, the area of coverage protection cannot be utilized as efficiently as with a rectangular- or square-shaped area with the same amount of square footage as would be provided with a gabled or double pitched canopy. Because the design of these shelters relies on the canopy sleeves to hold the shelter poles in place and to maintain the configuration of the frame when deployed, the sleeves and canopy must run the entire length of the poles so that the shelter is typically a tent. This is not ideal in settings such as the beach, where the user merely wants shade, the ability to see their surroundings, and the ability to enter and exit from underneath the shelter easily.

Other shelters similarly utilize a tension effect caused by the bowing of the shelter's frame in the canopy to force the shelter into its deployed configuration. In these shelters, the framing is fairly flexible and sown into the canopy. The shelter is collapsed by reorienting and folding it to flatten the overall configuration of the shelter. However, due to the flexibility needed for the shelter's frame, such shelters tend to be small because the frame cannot be sufficiently rigid to support itself and the shelter canopy. These shelters typically can only be used by one to two people at the most and have a minimal height so that the user cannot stand up within the shelter or place a chair or chaise lounge therein.

Other shelters have configurations that are similar to umbrellas. The shelters, however, are not truly freestanding because they rely on an anchor pole forced into the ground. Such shelters also suffer from the limitation that there is less head space compared to a shelter with gabled or doubled pitched canopy.

Other collapsible freestanding shelters rely on a series of segments that are pivotally linked in an x configuration. When the shelter is set up, the segments are extended in a scissor like manner. When the shelter is folded, the segments are retracted. This type of shelter suffers from several disadvantages. For example, the series of X-linked segments weighs more than a straight pole, rod, or strut used to connect the legs and roof frame of the shelter. In addition, the use of the x-linked segments adds to the bulkiness of the unit when collapsed.

Other shelters achieve a high degree of compactness when folded, but are not freestanding and ropes have to be attached to the shelter and an immovable object like a stake in the ground.

It would be desirable to provide a freestanding, collapsible shelter that can be quickly deployed by one person to obtain shade or protection from the elements in recreational settings. It would also be desirable to provide a shelter capable of being collapsed quickly into a compact, lightweight unit for storage.

SUMMARY OF THE INVENTION

The present invention is directed toward a free-standing, collapsible shelter that is adapted for use in recreational settings. The shelter includes a central hub, ridge poles that extend from the central hub and gable poles attached to the ridge poles. A ridge pole strut is coupled to each of the gable poles and a ridge pole that allows the gable poles to be folded toward each other and ultimately in a plane that is parallel to the ridge pole members. When deployed, the ridge pole strut maintains the gable poles in one position, reinforces the gable poles and confers stability to the shelter's roof frame. The folding capability is due to the coupling of the ridge pole strut to the ridge pole via a pivoting hinge plate. The hinge plate allows the ridge pole strut to pivot so that it does not impede the folding of the gable poles toward each other. Legs are attached to the gable poles by joints that have channels.

BRIEF DESCRIPTION OF THE DRAWINGS

FIG. 7A illustrates an isolated view of an endplate when the gable poles are not fully deployed, while FIG. 7B illustrates an endplate when the gable poles are fully deployed.

FIG. 8A is a rear view of the end panel when the shelter is not deployed, while FIG. 8B is a side view of the end panel when the shelter is deployed.

FIG. 9A illustrates a side view of a pole joint, and FIG. 9B illustrates a rear view of a pole joint and a leg disposed within a pole joint channel.

DETAILED DESCRIPTION OF THE INVENTION

Figure 4:
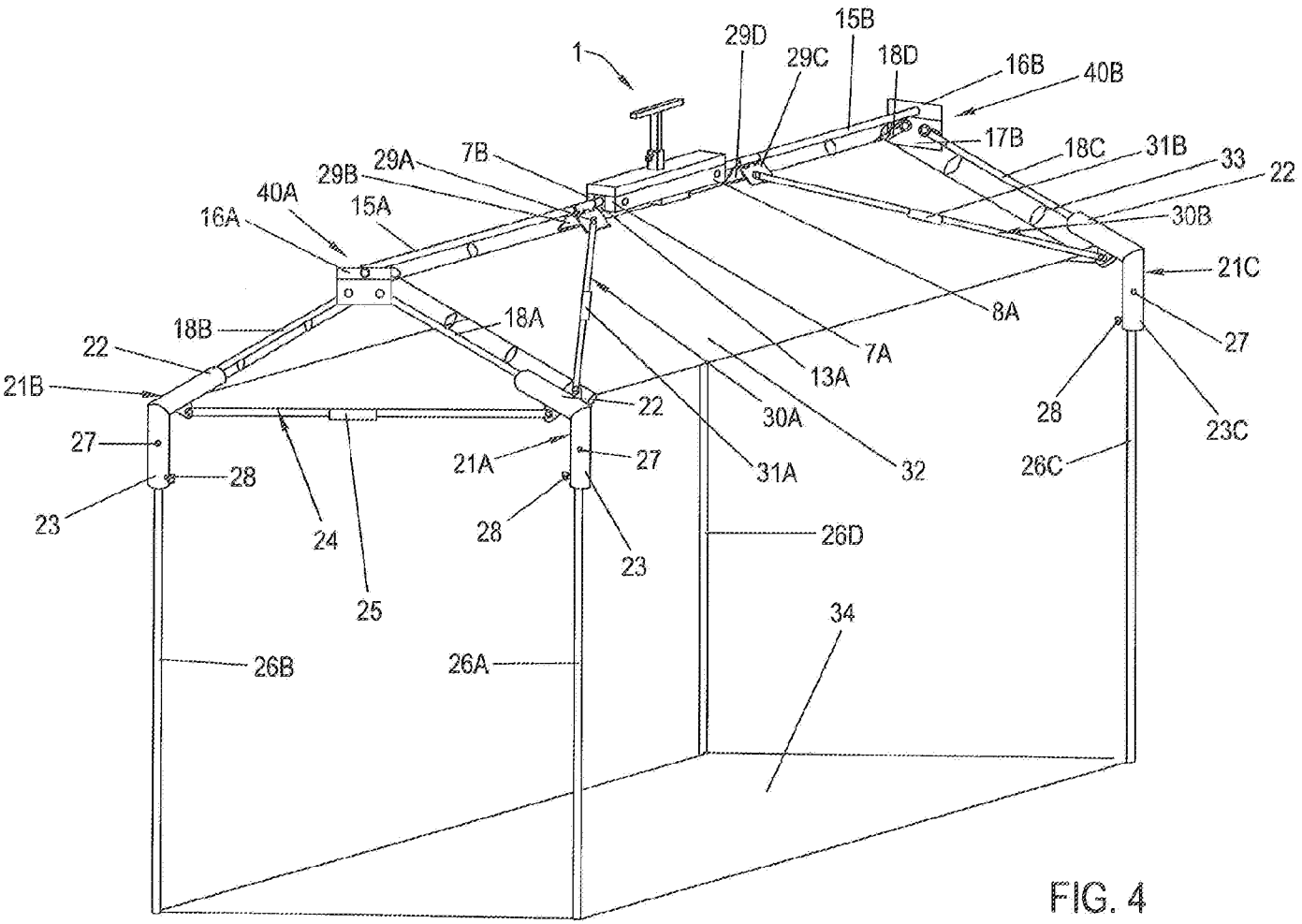
FIG. 4 illustrates a side perspective view of the collapsible shelter in accordance with an embodiment of the invention.

The present invention is directed toward a freestanding, collapsible structure. Referring first to FIG. 4, it may be seen that the structure includes a roof section and a leg section. The roof section includes a central hub 1, a first ridge pole 15A, and a second ridge pole 15B. The proximal ends of the ridge poles 15A, 15B are pivotally coupled to the roof hub 1 (described in greater detail below). The leg section may include a plurality of leg members operable to support the roof structure over a surface in a freestanding manner when the shelter is disposed in its deployed position.

Figure 1B:
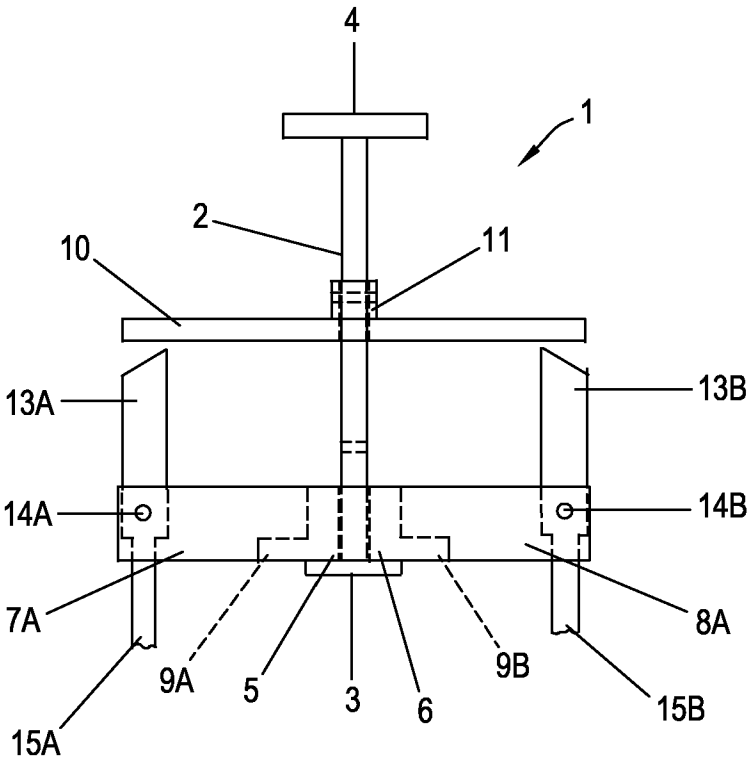
FIGS. 1A and 1B illustrate front views of the central hub in accordance with an embodiment of the invention, showing a deployed configuration (FIG. 1A) and a collapsed or stowed configuration (FIG. 1B).
Figure 1A:
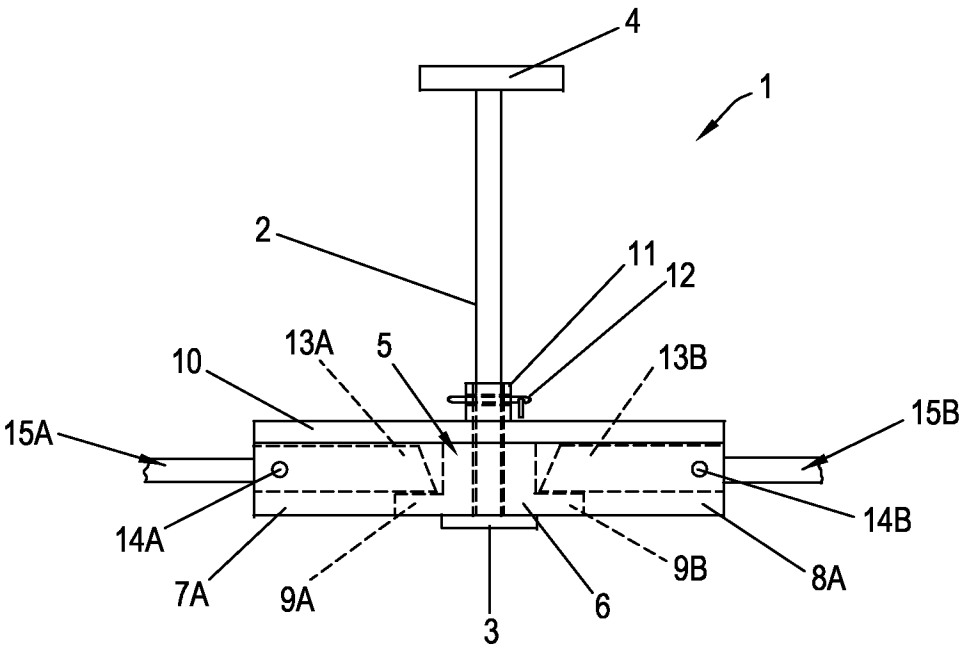
Figure 2:
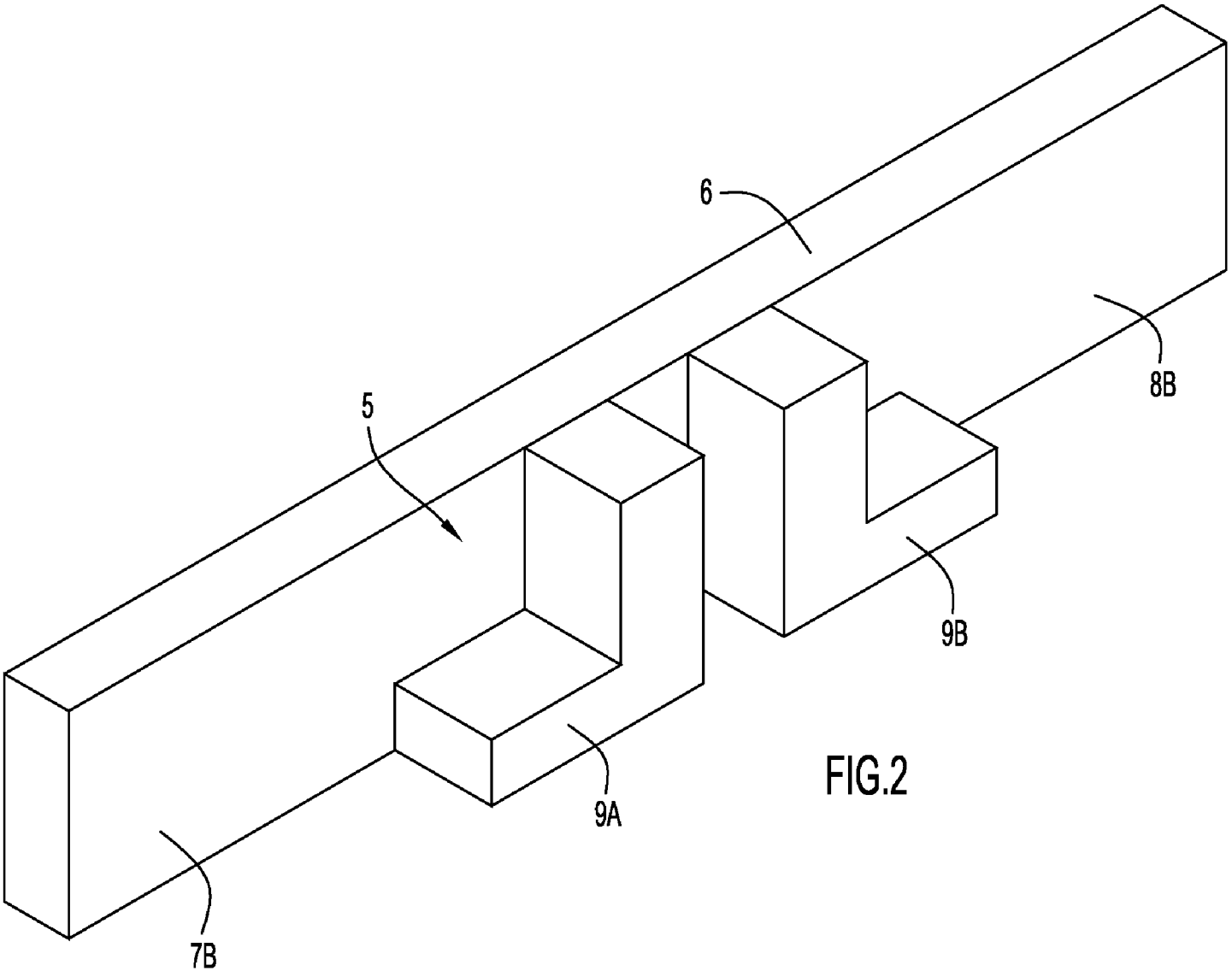
FIG. 2 illustrates a perspective view of the central hub bottom plate in isolation, with a portion removed to show bridge members.
Figure 3:
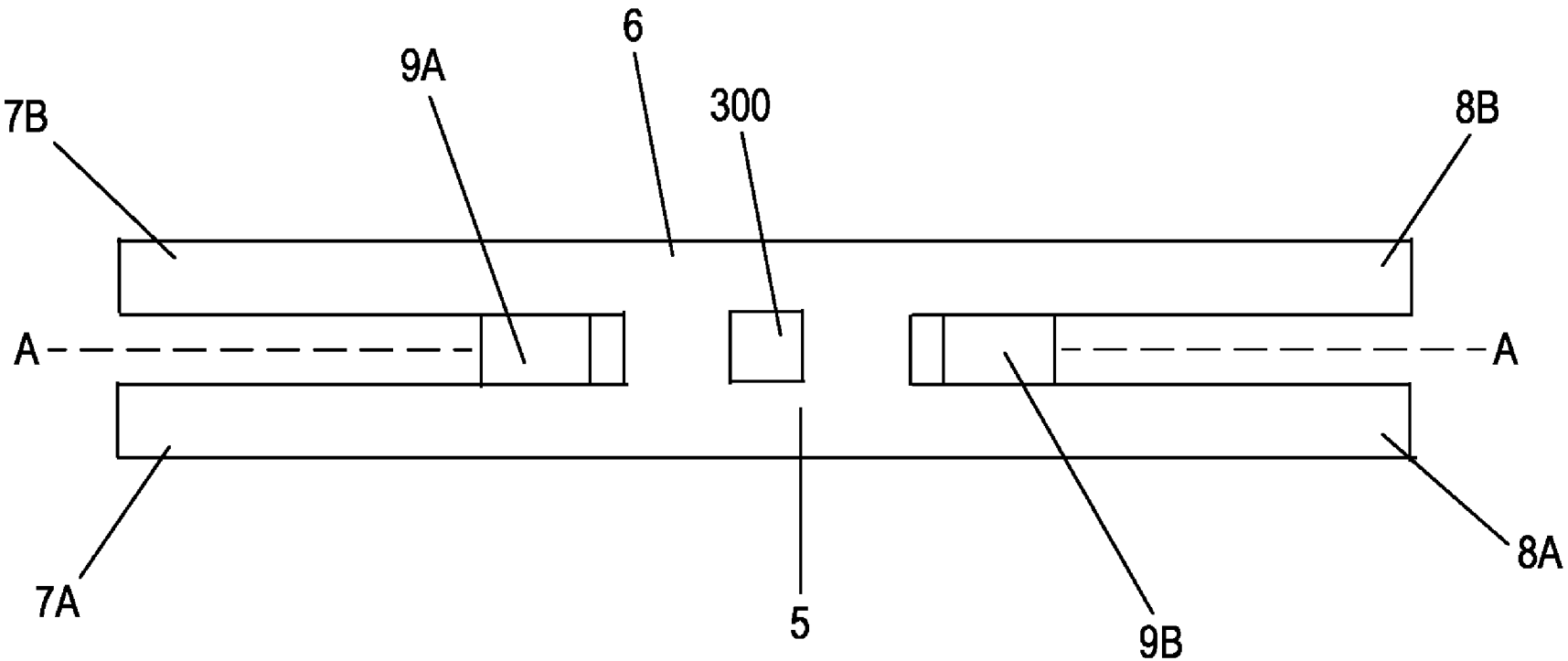
FIG. 3 illustrates an isolated top view of the central hub bottom plate.

FIGS. 1A, 1B show isolated views of a central hub 1 configured to selectively permit the folding of ridge poles 15A, 15B. As shown, the central hub includes a shaft 2 having a shaft base or stop plate 3 attached at one end and a shaft handle 4 attached at the other. Referring to FIG. 3, the central hub 1 includes a bottom plate assembly 5 including a central portion 6 from which a first pair of parallel arms 7A, 7B and a second pair of parallel arms 8A, 8B extends outward. Each pair of arms 7A, 7B, 8A, 8B forms an open gap or channel. The channels cooperate to generally define a hub axis A along which the ridge poles are aligned when oriented in their deployed positions. Additional pairs of arms may be located on the other sides of the central portion 6. Bridge or stop members 9A, 9B are located between arms 7A/7B and 8A/8B (within the channels), and are configured to stop the rotation of the ridge poles 15A, 15B (discussed in greater detail below). A pass-through 300 may exist within central portion 6 to permit the passage of the shaft 2.

The bottom plate assembly 5 may be slidably coupled to shaft 2 between stop plate 3 and shaft handle 4. A central hub top plate 10, slidably coupled to shaft 2, may be disposed between the bottom plate assembly 5 and the shaft handle 4. Stop plate 3 and shaft handle 4 should be of sufficient dimensions to prevent the bottom plate 5 and the top plate 10 from sliding off shaft 2.

A shaft collar 11 is disposed on central hub top plate 10 such that it extends distally from the top plate, toward shaft handle 4. Shaft collar 11 includes a hole on its side that perforates its thickness. It may also include a second hole that is aligned with the first hole. Shaft 2 includes a hole with which the hole or holes in shaft collar 11 can be aligned so that shaft pin 12 inserted to maintain central hub top plate 10 firmly in place against central hub bottom plate 5 and to maintain the bottom plate assembly 5 firmly in place against the stop plate 3.

Other means may be utilized to maintain central hub top plate 10 firmly in place against the bottom plate assembly 5 and to maintain the bottom plate assembly 5 firmly in place against the stop plate 3. For instance, a hole could be located in shaft 2 (through which a pin is inserted) that is directly adjacent the top plate 10 instead of being inserted through the hole in shaft collar 11. In another embodiment, a clamping or locking device, such as a C-clamp or similar device that relies on a drive screw mechanism to secure it in place, can be secured directly above the top plate 10 to maintain the top plate 10 firmly in place against the bottom plate assembly 5 and to maintain the bottom plate assembly 5 firmly in place against stop plate 3. In such an embodiment, a slot, groove, hole, or pit formed into the shaft 2 could be engaged by a portion of the clamping device to prevent the clamping device from being displaced from its position on shaft 2. By way of further example, the clamping or locking device could comprise a device that includes a handle or tab that the user pushes down to force a cam type mechanism to lock in place on shaft 2. Again, a portion of this mechanism may engage a slot, groove, hole or pit formed into the shaft 2.

In each case, it is generally desirable that the movement of the bottom plate assembly 5 and the top plate 10 is minimized. As shown in FIGS. 1A, 1B, 2, 4, and 13, pole butts 13A, 13B, located between arm pairs 7A/7B, 8A/8B, are pivotally attached to each pair of arms by butt pins 14A, 14B such that the ends of pole butts 13A, 13B proximate the central portion 6 can selectively pivot such that the pole butts protrude above the arm pairs 7A/7B, 8A/8B but not below the arm pairs. That is, the bridge members 9A, 9B prevent the pole butt ends from protruding below arm pairs 7A/7B, 8A/8B. The ends of pole butts 13A, 13B that are closest to the central portion of central hub bottom plate assembly 5 may be rounded or tapered downward toward bridge members 9A, 9B. If additional pairs of arms are included on the bottom plate assembly 5, a pole butt may likewise be located between each arm pair and pivotally attached by a butt pin.

Ridge poles 15A, 15B extend generally horizontally from the central hub 1 to form the ridge of the shelter roof. The ridge poles 15A, 15B extend distally from the distal ends of pole butts 13A, 13B (i.e., the ends that are farthest away from the central portion 6). Likewise, ridge poles may also extend from any other ridge pole butts attached to the bottom plate assembly 5. Each of ridge poles 15A, 15B extends outward in a generally straight direction from pole butts 13A, 13B (i.e., along the hub axis A). In other embodiments, ridge poles 15A, 15B (and any other ridge poles) may extend downward from the pole buts to which they are attached.

When central hub top plate 10 is secured against the bottom plate assembly 5, the top plate 10 pushes against the ends of pole butts 13A, 13B, urging them downward into the gaps/channels between the arm pairs 7A/7B, 8A/8B until stopped by a corresponding bridge member 9A, 9B. As a result, the pole butts 13A, 13B may pivot approximately 90 degrees such that that the ends of the pole butts may become generally parallel to the top surfaces of arm pairs 7A/7B, 8A/8B (FIG. 1B). The tapering or rounding of the ends of pole butts 13A, 13B that are opposite ridge poles 15A, 15B makes it easier for central hub top plate 10 to push pole butts 13A, 13B into the gaps formed by arm pairs 7A/7B, 8A/8B.

Once central hub top plate 10 is secured, the ends of pole butts 13A, 13B opposite ridge poles 15A, 15B are held in place between the top plate 10 and bridge members 9A, 9B so that pole butts 13A, 13B; ridge poles 15A, 15B; and central hub 1 form a rigid unit. The top plate 10 would likewise secure any additional pole butts pivotally attached to the bottom plate 5 when the top plate 10 is secured within the bottom plate assembly 5.

The central hub 1 and its components may be formed of any suitable materials having sufficient strength and rigidity to maintain central hub 1 as a rigid component of the shelter. By way of example, the central hub 1 and its components may be formed from metals (such as aluminum, steel, or iron), plastic (such as polycarbonate, styrene, or polypropylene), and wood (such as pine, oak, redwood, ash, or cypress).

Figure 5:
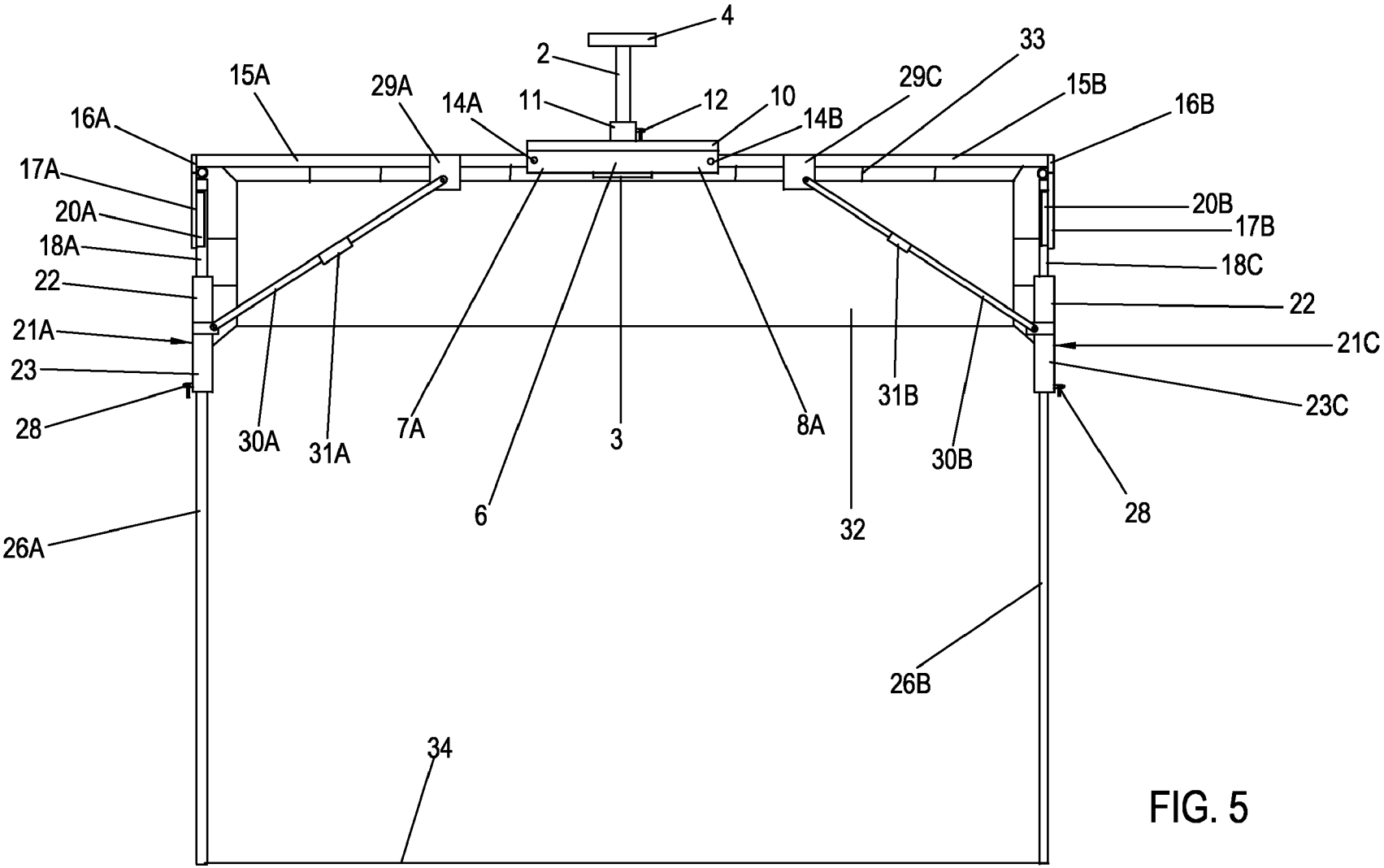
FIG. 5 illustrates a front view of the shelter shown in FIG. 4.
Figure 6:
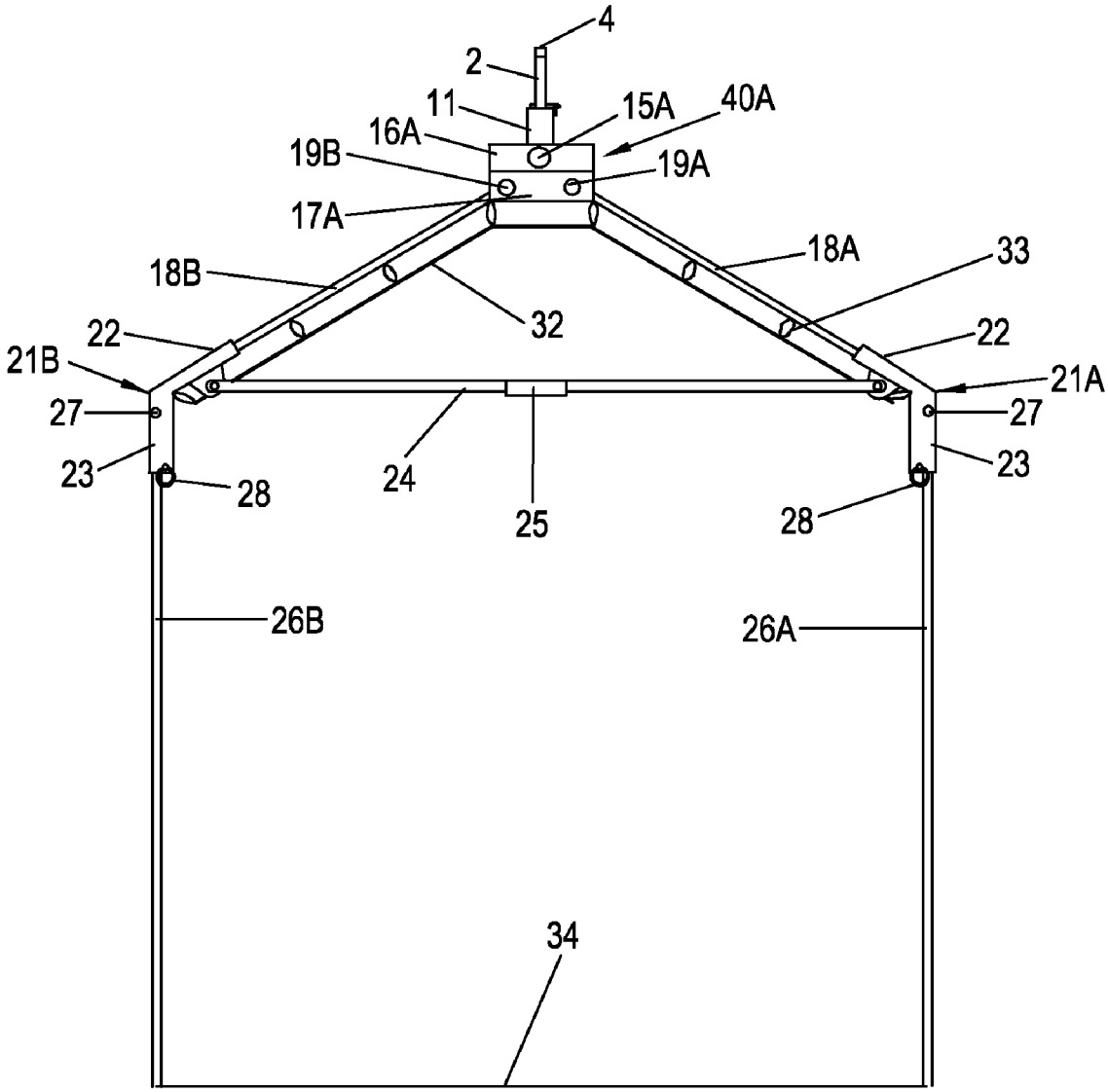
FIG. 6 illustrates a side view of the shelter shown in FIG. 4.
Figure 7A:
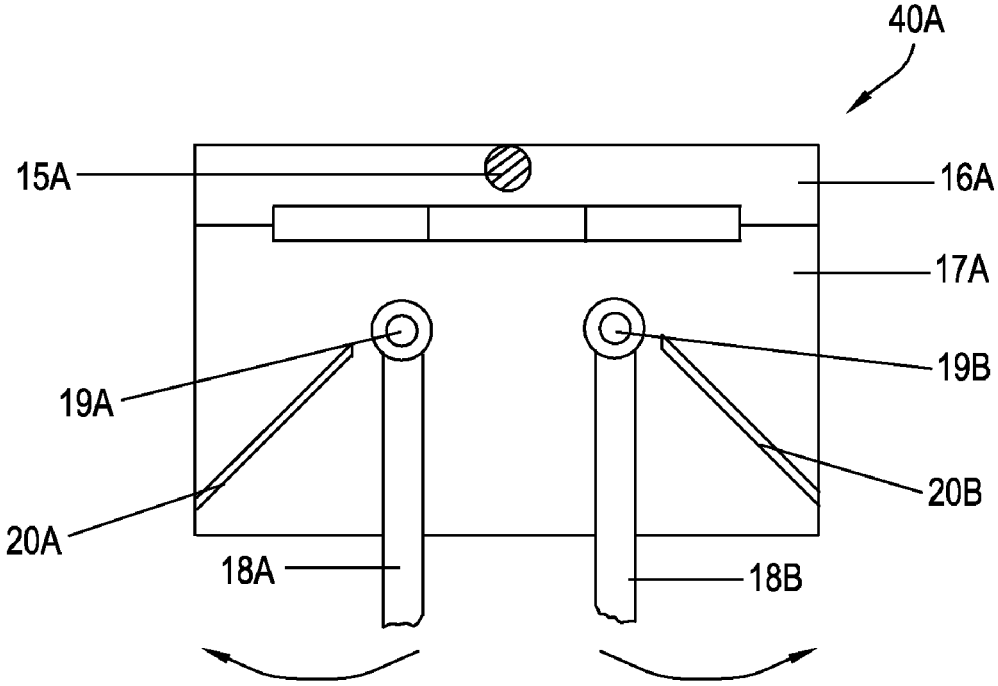
FIGS. 7A-7B illustrate views of the endplates in isolation from the side to which they are coupled to the ridge poles, in accordance with an embodiment of the invention, showing the pivotal connection of gable poles thereto. Specifically.
Figure 7B:
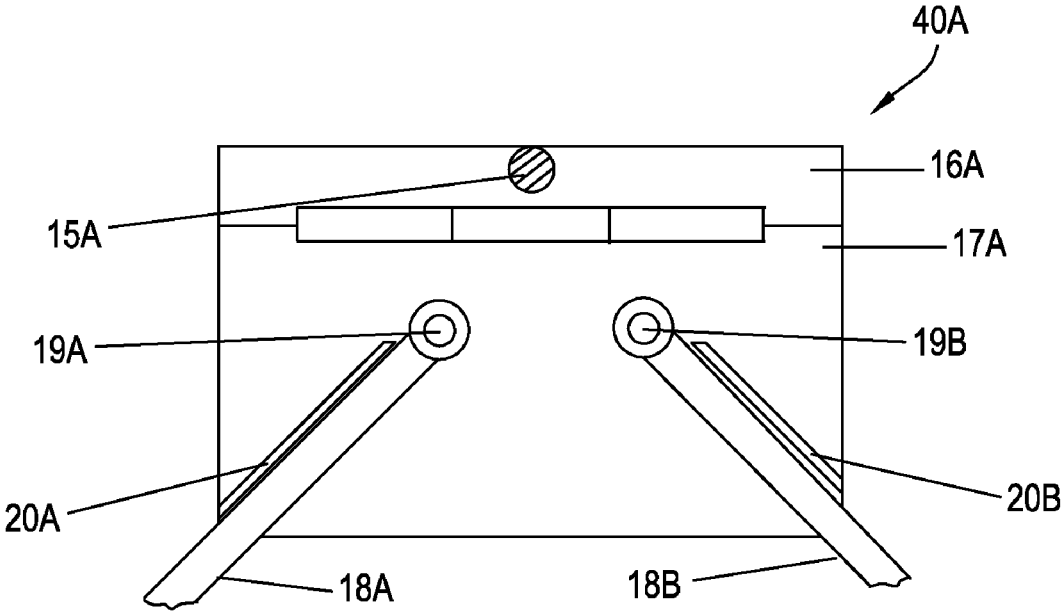
Figure 13:
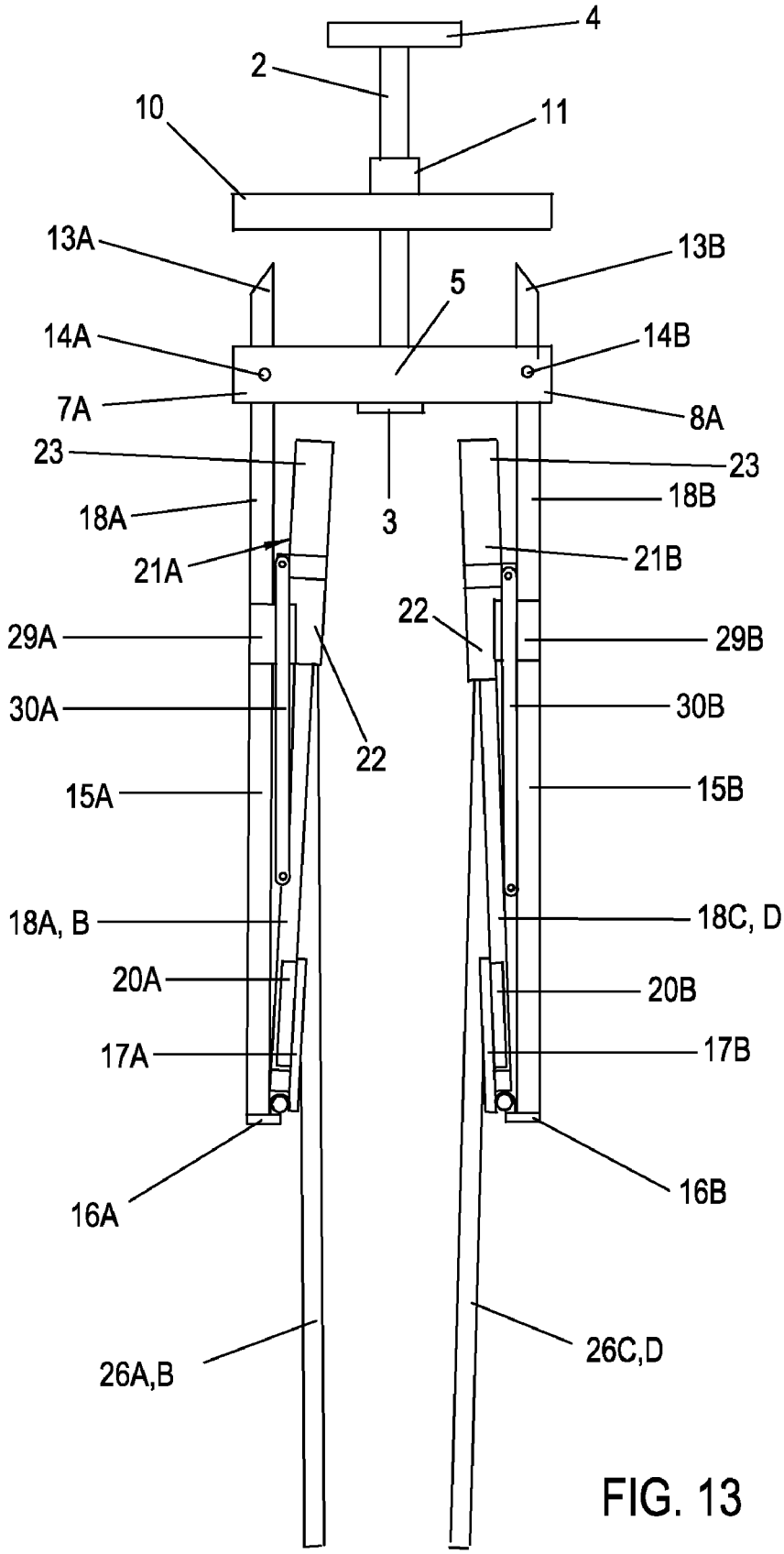
FIG. 13 illustrates the collapsible shelter of FIG. 4 in its stowed position. Like reference numerals have been used to identify like elements throughout this disclosure.

The frame of the shelter further includes connection elements or end panels operable to permit the rotation of gable poles with respect to the ridge poles 15A, 15B. Referring to FIGS. 4, 5, and 13, the distal ends of the ridge poles 15A, 15B (the ends disposed away from the pole butts 13A, 13B) are each attached to corresponding end panels 40A, 40B. As best seen in FIGS. 6, 7A, and 7B, a first end panel 40A includes a bottom section 17A hingedly coupled to a top section 16A. Likewise, a second end panel 40B includes a bottom section 17B hingedly attached to a top section 16B. Gable poles 18A, 18B, 18C, 18D are pivotally attached to end panel bottoms 17A, 17B via gable pole pivot pins 19A, 19B, 19C, 19D (seen in FIGS. 7A and 7B).

Another embodiment of the end panels 40A, 40B is shown in

Figure 8A:
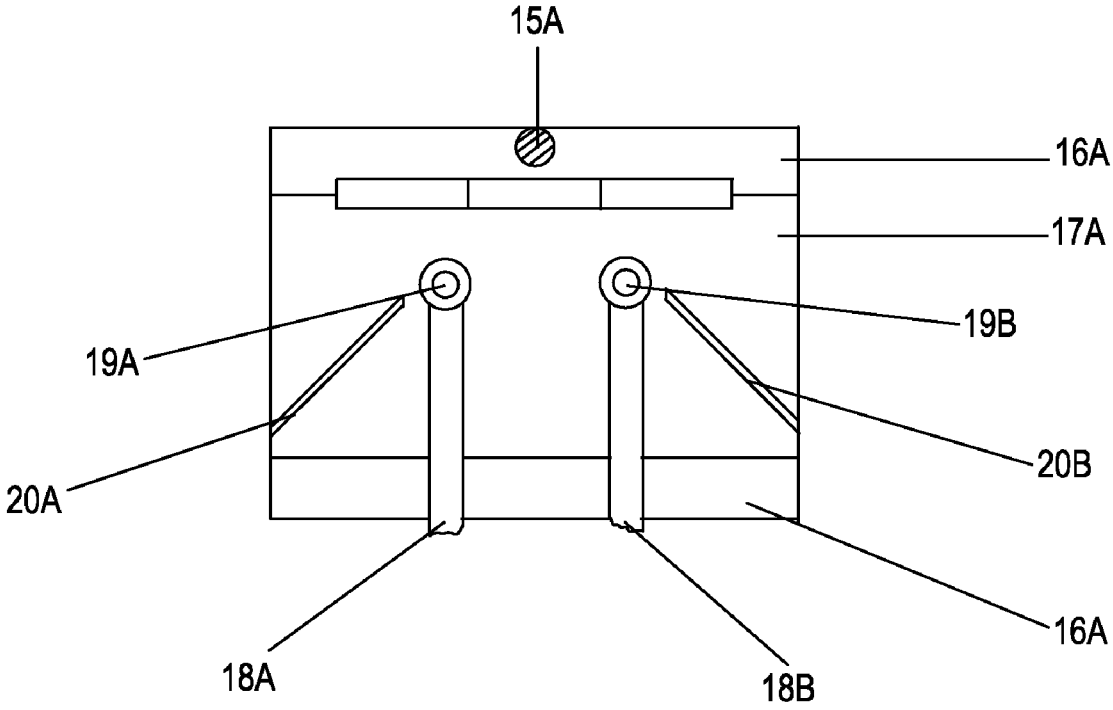
FIGS. 8A-8B illustrate views of an endplate in accordance with another embodiment of the invention, showing an endplate having an end panel bottom attached above the lower edge of the end panel top. Specifically.
Figure 8B:
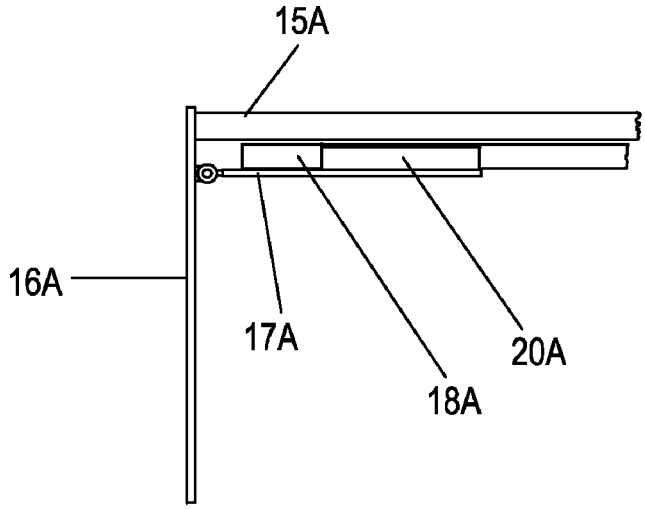

FIGS. 8A and 8B. As shown, the bottom edge of end panel top 16A may extend below the top of edge end panel bottom 17A so that end panel bottom 17A is pivotally or hingedly attached to end panel top 16A above its bottom edge and the portion of end panel top 16A between the top edge of end panel bottom 17A and the lower edge of end panel top 16A serves as a backstop to limit the arc that end panel bottom 17A can pivot, swing, or move. In such embodiments, end panel bottom 17B may likewise be attached to end panel top 16B. The backstops in such embodiments serve to increase the stability of the shelter's roof frame by limiting the lateral movement of the end bottom panels which, in turn, limits the lateral movement of the gable poles.

With this configuration, the gable poles 18A-18D are capable of pivoting from their deployed position, in which they are disposed at an angle (e.g., an obtuse angle or an acute angle with respect to the plane including the roof hub its axis A (e.g., a generally horizontal plane oriented generally parallel to the supporting surface)) to form a gabled roof, to a stowed position, in which the gable poles are oriented generally parallel to each other (and generally perpendicular to the roof hub axis A). The bottom section 17A, 17B of the end panel 40A, 40B, moreover, may be rotated with respect to the upper section 16A, 16B to orient the gable poles 18A-18D in a plane generally parallel to the ridge poles 15A, 15B in their stowed position (i.e., generally perpendicular to the axis A defined by the arms 7A/7B, 8A/8B of the central hub 1).

In some embodiments, additional gable poles may be attached to pole butts that are, in turn, attached to central hub 1 in the same manner as ridge poles 15A, 15B. Gable poles may also be attached to ridge poles 15A, 15B.

An outward extending flange or rib 20A may be formed into the end panel bottom 17A to limit the pivot arc of a gable pole 18A from a position of being parallel to gable pole 18B to 90° or less when it is pivoted outward to the point where its pivot is stopped by flange 20A. Flange 20B is likewise located on end panel bottom 17A to limit the pivot of gable pole 18B. Flanges 20C, 20D are likewise located on end panel bottom 17B to limit the pivot of the gable poles 18C, 18D.

The degree of arc is not particularly limited. Preferably, the maximum arc that can be formed by the pivot of each gable pole from a position of being parallel to its adjacent counterpart to the point where its pivot its stopped by a flange is 45°. By way of further example, the arc may be between 80°-90°, 70°-80°, 60°-70°, 50°-60°, 40°-50°, 30°-40°, 20°-300, and 10°-20°. Other degree ranges are also contemplated.

In some embodiments, the end panel tops 16A, 16B and end panel bottoms 17A, 17B are combined into one piece and pivotally attached to the ridge poles 15A, 15B. In such embodiments, the gable poles are pivotally attached to the one piece end panel by gable pole pins 19A-19D and the movement of the gable poles 18A-18D are limited by flanges 20A-20D attached to the end panel 40A, 40B as discussed above.

The gable poles 18A-18D are coupled to respective legs 26A, 26B, 26C, 26D via corresponding pole joints 21A, 21B, 21C, 21D. As shown in FIGS. 4, 5, 6, 9A, 9B, and 13, each of pole joints 21A, 21B, 21C may include an upper segment 22 and a lower segment 23 contiguous with each other and oriented such that each of the pole joints 21A, 21B, 21C are bent, e.g., to an angle of 90° or greater. Likewise, the pole joint attached to gable pole 18D includes upper 22 and lower 23 segments. The distal ends of gable poles 18A, 18B, 18C (i.e., the ends that are not connected to end panel bottoms 17A, 17B) are attached to upper segments 22. Likewise, the end of gable pole 18D that is not connected to an end panel bottom is attached to the upper segment of the pole joint attached to gable pole 18B. Gable strut 24 may include two segments configured to pivot with respect to each other proximate the center of the strut such that a V-fold configuration results. As shown in FIGS. 4 and 6, the gable strut 24 may further include a gable strut sleeve 25 slidably mounted on gable strut 24, which, when slid over the pivot joint of the segments of gable strut 24, prevents the two segments from pivoting. The ends of the gable strut 24 may be pivotally coupled to pole joints 21A, 21B. In some embodiments, gable strut 24 may be directly attached to gable poles 18A, 18B.

Similarly, a gable strut 24 including two pivoting segments is attached to pole joint 21C and 21D (the pole joint attached to gable pole 18D) (not illustrated). A gable strut sleeve 25 is likewise slidably located on the gable strut 24 which, when slid over the pivot joint of that gable strut, prevents the two segments comprising the gable strut from pivoting.

Other means may be utilized to prevent the segments comprising gable strut 24 and the gable strut attached pole joint 21C from pivoting. In some embodiments, there are no gable strut sleeves or other means for preventing the segments comprising the gable struts from pivoting.

Figure 9B:
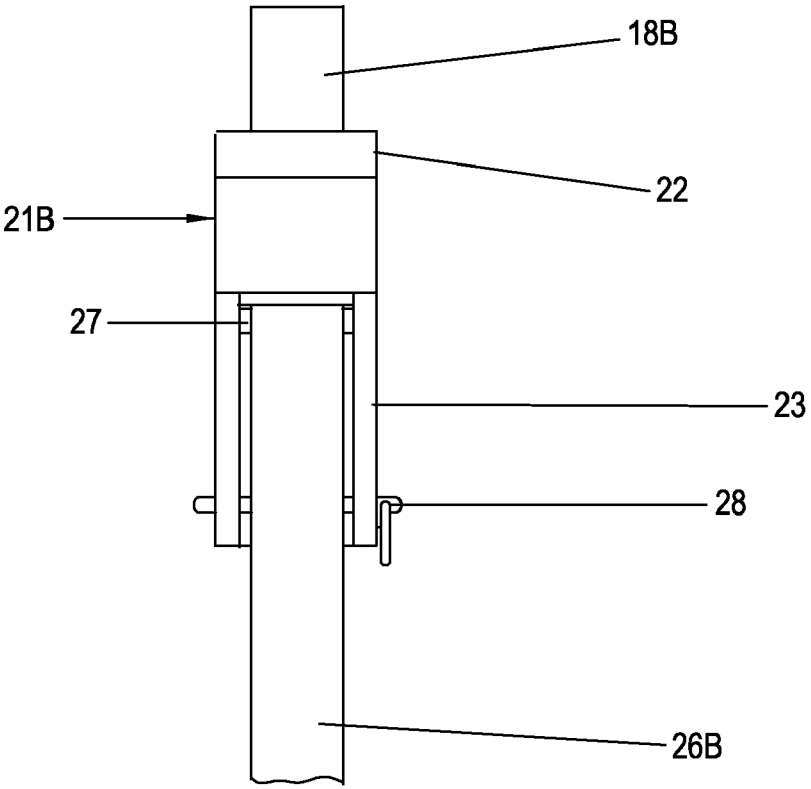
FIGS. 9A-B illustrate close-up views of the pole joints in accordance with an embodiment of the invention. Specifically.
Figure 9A:
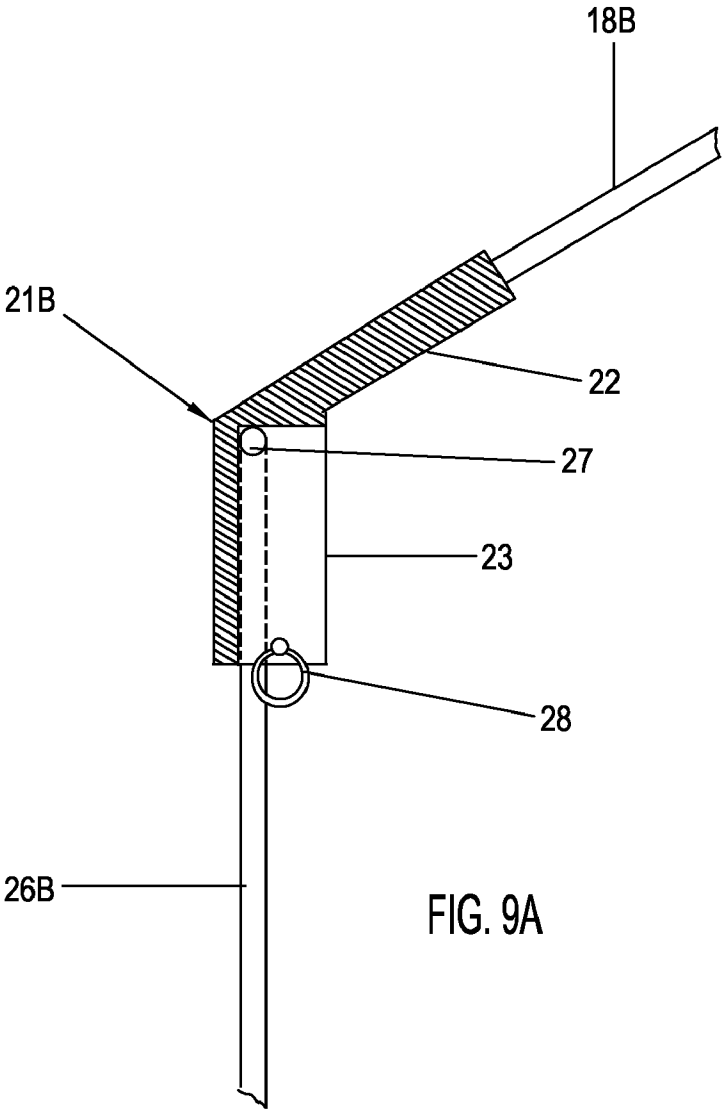

Referring to FIGS. 9A and 9B, a channel is located at the bottom of each of the lower segments 23 of the pole joints 21A, 21B, 21C, 21D. That is, the channel opens at the end opposite the upper segments 22. One end of each of leg 26A, 26B, 26C, 26D is partially housed within the channels of the lower segments 23, and is pivotally coupled to the pole joints 21A, 21B, 21C, 21D by leg pins 27 (discussed in greater detail below).

Legs 26A, 26B, 26C, 26D may be retractable or foldable to make the shelter more compact overall when it is folded. In some embodiments, the poles, bars, struts or other structural features may be pivotally attached, or attachable when the shelter is being deployed, or otherwise attached between legs 26A/26B; 26B/26C; 26C/26D; 26D/26A, and/or in different combinations and to other parts of the shelter between the legs to add rigidity and/or stability to the shelter's frame.

A pair of aligned holes may be formed into the walls of each lower segment 23 such that when legs 26A, 26B, 26C, 26D are housed in their respective channel, restraining pins 28 may be inserted through the holes to secure the legs such that they can no longer pivot (thus constraining their movement).

A particular advantage of the design of the shelter herein is that the overall height of the shelter can be increased with minimum impact on its compactness when it is folded by increasing the length of the lower segments of the pole joints while locating the holes into which the leg pins are inserted as close as possible to the open ends of the lower segments to prevent the legs from pivoting when the legs are housed in their channels and the restraining pins are inserted into the holes.

Conversely, the compactness of the shelter when folded can be increased by reducing the length of the legs, but increasing the length of the lower segments of the pole joints to maintain the same height. In such an embodiment, the holes into which the restraining pins are inserted need to be located sufficiently close to the open ends of the lower segments to prevent the legs from being able to pivot when the restraining pins are inserted into the holes. The compactness of such embodiments is increased because the length of the legs is reduced which reduces the overall the length of the shelter when folded up. The overall length of the shelter is the largest dimension of the folded up shelter. In some instances, reducing the shelter's folded up length by a few inches permits the folded up shelter to otherwise be stored in a small space such as the cargo compartment of a compact car.

In some embodiments, the legs may not pivot in the pole joints. Instead, the legs are fixed to the pole joints and the upper and lower segments are pivotally attached to each other. In such embodiments means are included to secure the upper and lower segments in place when the shelter is in use and to maintain the pole joints in a configuration of 90° or greater to support the roof frame of the shelter.

As shown in FIGS. 4, 5 and 13, a first hinge plate assembly including hinge plates 29A, 29B may be disposed at a predetermined position along the first ridge pole 15A between central hub 1 and the first end panel 40A. The hinge plates 29A, 29B are configured such that that they can swing or pivot in approximately the same arc as gable poles 18A, 18B. Likewise, a second hinge plate assembly including hinge plates 29C, 29D may be disposed at a predetermined location along the second ridge pole 15B, between the central hub 1 and second end panel 40B and are attached in a manner so that they can swing or pivot in approximately the same arc as gable poles 18C, 18D.

Ridge pole struts 30A, 30B may each include two segments that are pivotally attached to each other at one end so that they can pivot in a V-fold configuration. One end of each of ridge pole struts 30A, 30B is pivotally attached to a corresponding hinge plate 29A, 29B. The other end of each of ridge pole struts 30A, 30B is pivotally attached to and associated pole joint 21A, 21B. A second set of ridge pole struts are likewise pivotally attached to a corresponding hinge plate 29C, 29D and pole joint 21C and 21D (21D being the pole joint attached to gable pole 18D).

Ridge pole strut sleeves 31A, 31B slide along ridge pole struts 30A, 30B, respectively, which, when slid over the pivot joint of the segments comprising ridge pole struts 30A, 30B prevents the segments from pivoting. Likewise, ridge pole strut sleeves are slidably located on the ridge pole struts attached to hinge plates 29C, 29D.

Other means may be utilized to prevent the segments comprising ridge pole struts 30A, 30B from pivoting. In some embodiments, there are no ridge pole strut sleeves or other means for preventing the segments comprising the ridge pole struts from pivoting.

Hinge plates 29A, 29B are further hingedly attached to ridge pole 15A so that when gable poles 18A, 18B are folded toward each other, ridge pole strut 30A and the ridge pole strut attached to hinge plate 29B also move toward each other. Without the hinge plates, the ridge pole struts can only move in one plane. However, as explained in greater detail below, the gable poles to which the hinge plates attach must be folded in two planes. They are first folded toward each other in a plane that is transverse and perpendicular to the plane of the ridge poles. In the next step, the gable poles are folded toward the ridge poles in the same plane. Consequently, for the shelter to be folded up, a means must be utilized to allow the ridge pole struts to pivot in multiple planes. The hinge plates achieve that function.

Without the hinge plates, the ridge pole struts could not fold with the gable poles such that both the gable poles and ridge pole struts could not be parallel to the ridge poles and would thus stick out from the shelter when it is folded up. This, in turn, would reduce the overall compactness of the shelter when it is in a folded up configuration. Likewise, hinge plates 29C, 29D are further hingedly attached to ridge pole 15B so that when gable poles 18C, 18D are folded toward each other, ridge pole strut 30B and the ridge pole strut attached to hinge plate 29D also move toward each other.

The ridge poles, ridge pole struts, ridge pole strut sleeves, gable poles, gable struts, gable strut sleeves, pole joints and legs may be formed from any material of sufficient strength and rigidity to maintain the frame of the shelter as a rigid unit when the shelter is in use. Such materials could include metals (e.g., aluminum, steel, or iron), plastic (e.g., polycarbonate, styrene, or polypropylene), and wood (e.g., oak, redwood, ash or cypress).

Roof canopy 32 is attached to the pole joints, gable poles, and/or ridge poles via attachment cord 33 and its counterparts. Additional gable poles may be pivotally attached to central hub bottom plate assembly 5 or ridge poles 15A, 15B to provide additional support for roof canopy 32. Roof canopy 32 may also be attached to other portions of the shelter frame Preferably, an attachment cord 33 and its counterparts would be formed of a flexible or elastic material so that they are drawn tight when the shelter is unfolded and likewise draw roof canopy 32 tight.

Other means may be used to attach roof canopy 32 to the shelter frame. In some embodiments, the roof canopy 32 may have sleeves that house the ridge poles and gable poles. In other embodiments roof canopy 32 may be draped over the shelter and a cord drawn tight around the edges that are closest to the ground to draw roof canopy 32 around the shelter's frame.

Roof canopy 32 should be of sufficient area to provide shade or other protection over the footprint of the shelter. The selection of the material for roof canopy 32 depends on what capabilities are desired for the shelter. For example, if the shelter is intended to provide a rain shelter, then some type waterproof or water resistant material would be used for roof canopy 32. Such material could include plastic, Gore-Tex™, rubber-based material, water resistant/waterproof nylon, or water resistant/waterproof polyester. Additionally, if the shelter is intended to serve as shade then the material should be sufficient to block sunlight and could include such material as cotton cloth, polyester, or nylon. In other embodiments, roof canopy 32 may actually consist of panels that fold together. Roof canopy 32 may be detachable so that it can be removed to be hung up and dried or be washed.

The central hub, ridge poles, gable poles and roof canopy may be configured to give the roof of the shelter a number of different shapes. As shown in FIG. 4, the roof canopy 32 has a gabled or double-pitched configuration. This has particular utility when compared to shelters of the same height for which the roof has a pyramid or dome configuration because a gabled or double pitched roof has more head space overall for the users standing within the shelter.

Figure 10:
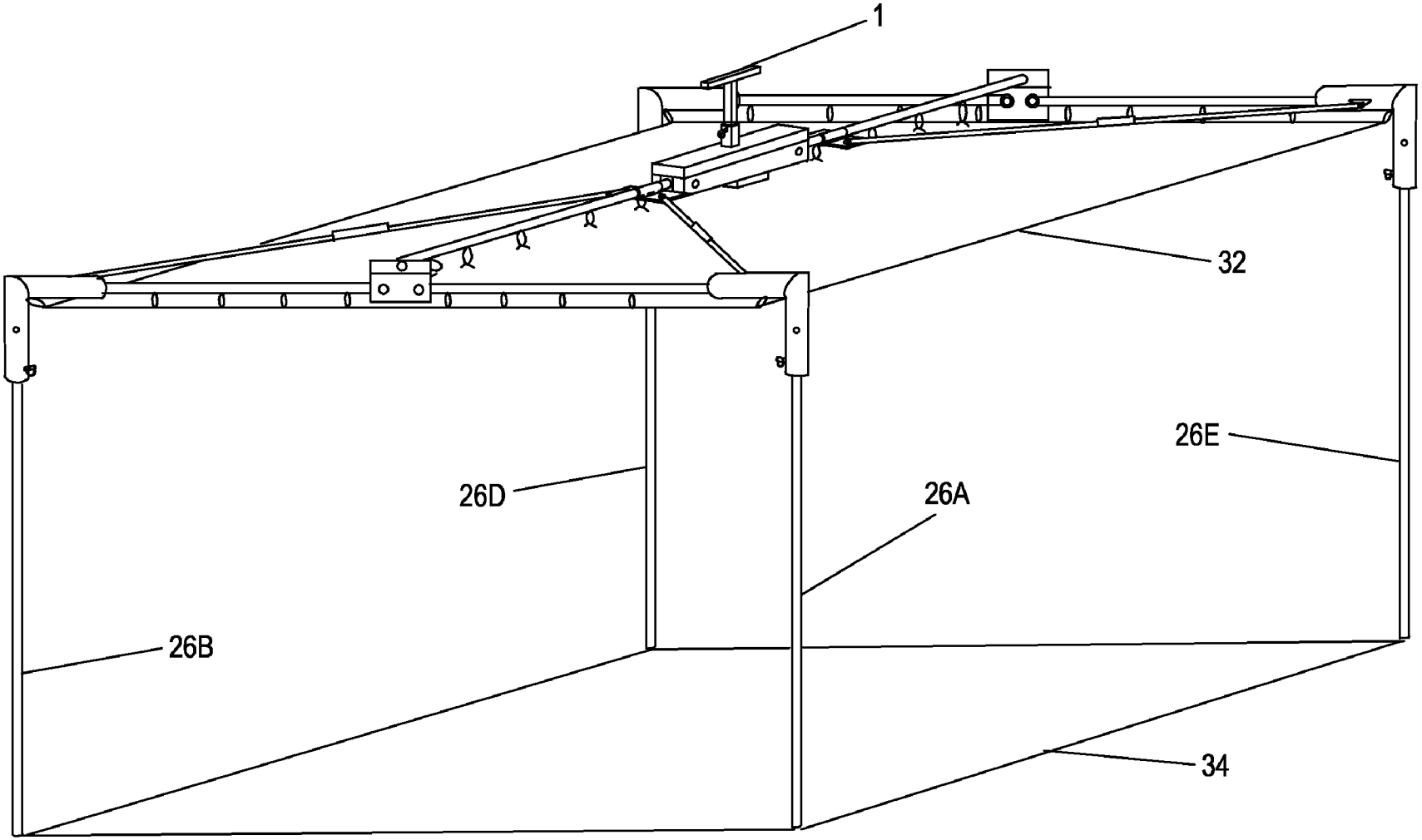
FIG. 10 illustrates a collapsible shelter in accordance with another embodiment of the invention, showing a shelter with a flat roof.
Figure 11B:
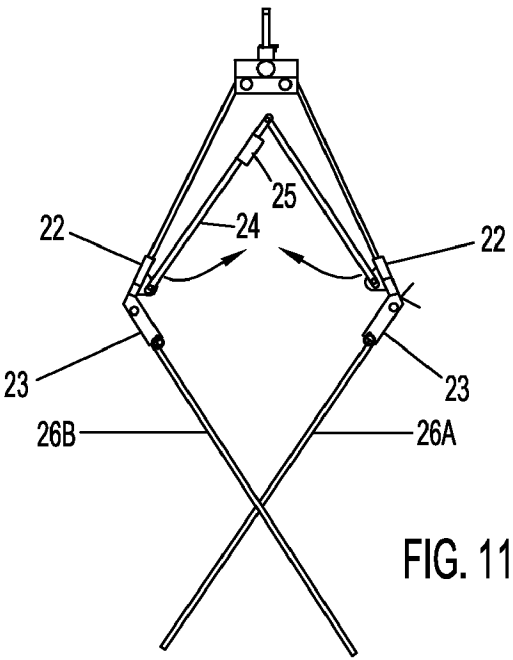
FIGS. 11A-11E illustrate side views of the collapsible tent, showing the folding of the tent from its deployed configuration to its stowed configuration.
Figure 11C:
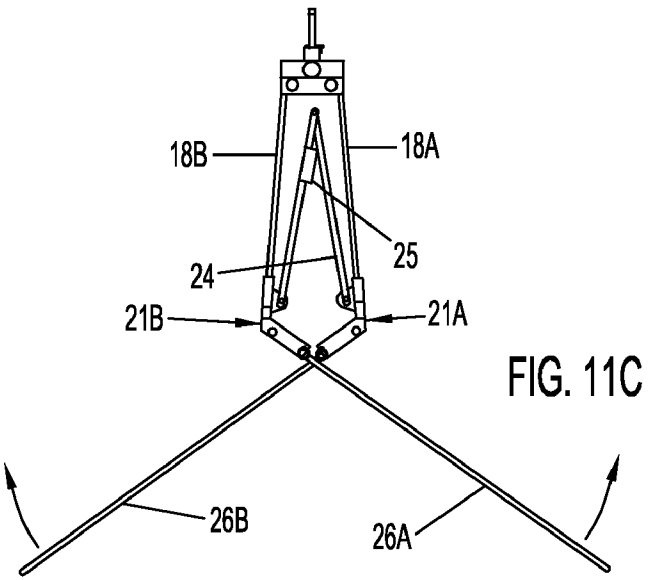
Figure 11A:
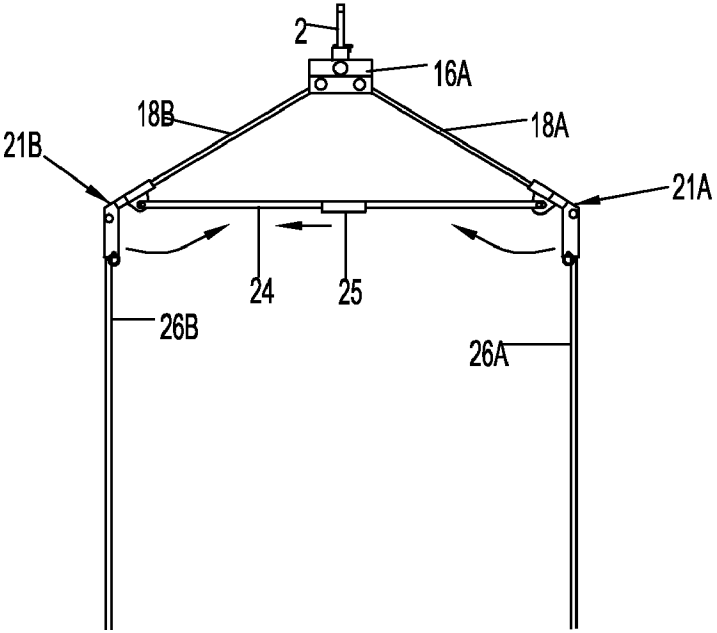
Figure 11E:
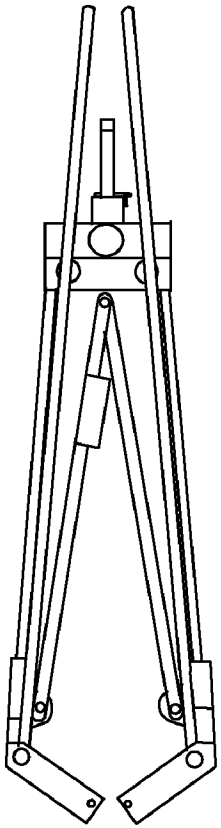
Figure 11D:
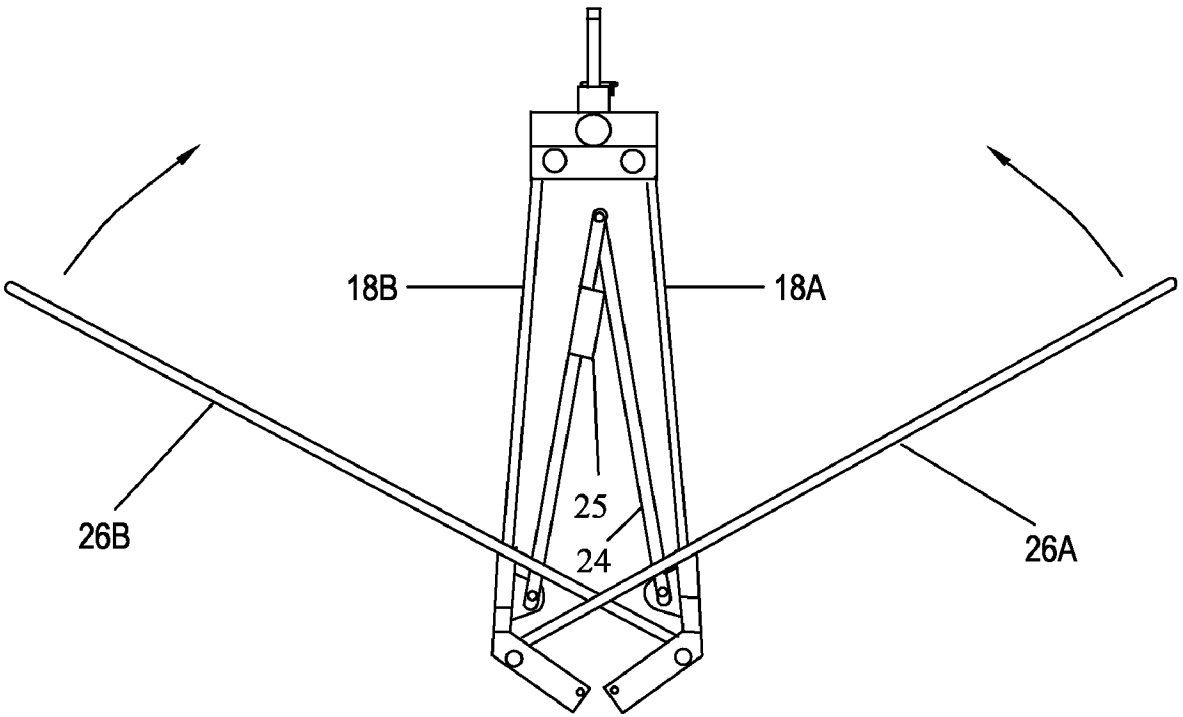
Figure 12B:
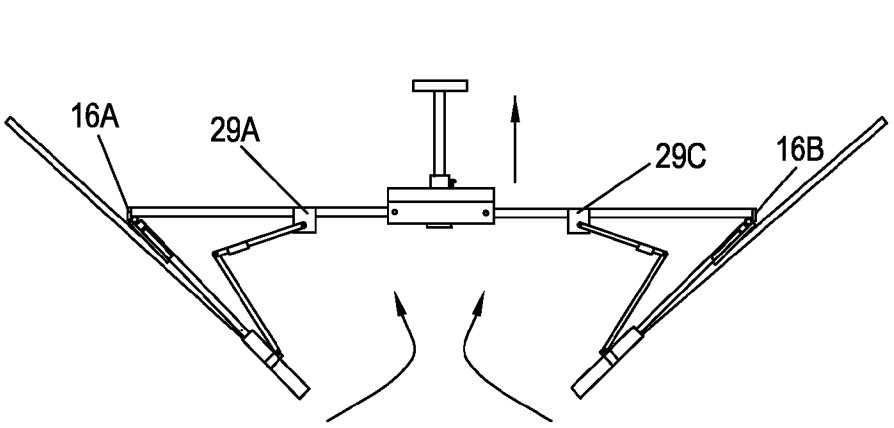
FIGS. 12A-12E illustrate front views of the collapsible tent, showing the folding of the tent from its deployed configuration to its stowed configuration.
Figure 12A:
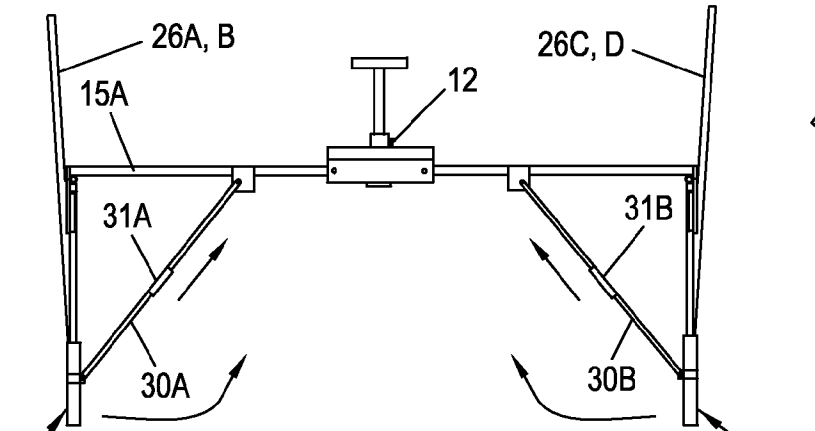
Figure 12C:
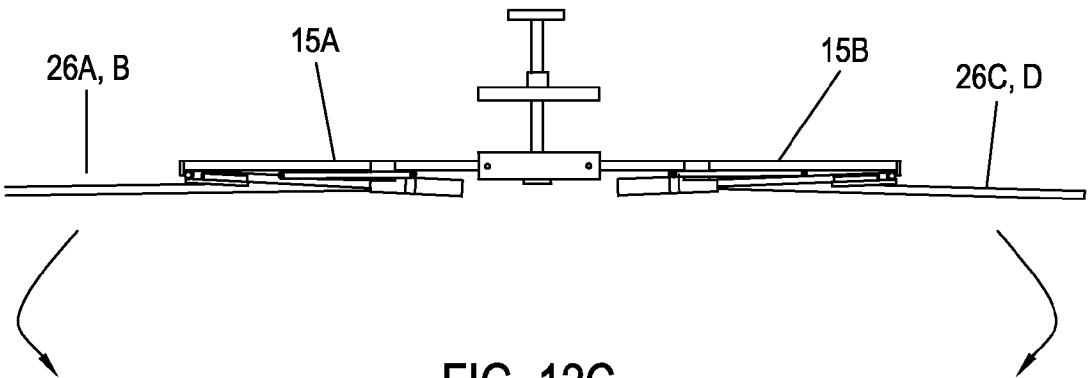
Figure 12E:
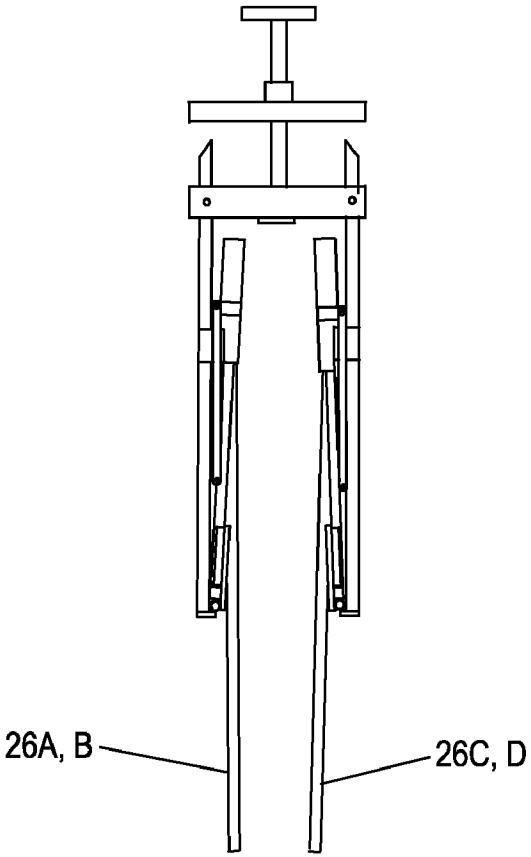
Figure 12D:
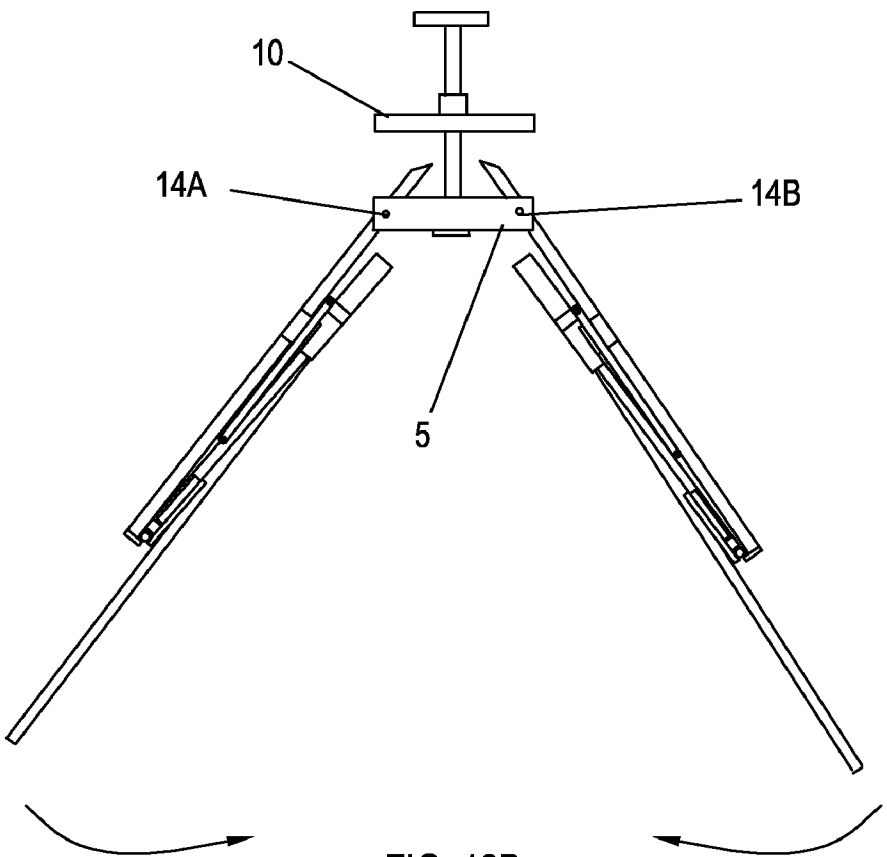

As shown in FIG. 10, the roof may also be generally flat, having no pitched profile.

In all embodiments, the pole butts may be secured in place between central hub top plate 10 and bridges 9A and 9B when the top plate 10 is secured in place.

The shelter may also include a floor tarp 34 attached to legs 26A, 26B, 26C, 26D. Floor tarp 34 may be formed of a variety of materials depending on its purpose. For example, if floor tarp 34 is intended to provide protection against moisture on the ground then material selected for floor tarp 34 could include plastic, Gore-Tex™, rubber-based material, water resistant/waterproof nylon, or water resistant/waterproof polyester or other waterproof or water resistant material. Additionally, if floor tarp 34 is intended to provide protection from sharp objects or keep debris away, it may comprise heavy material, such as canvas, that may be or may not be waterproof or water resistant. In some embodiments, floor tarp 34 could comprise folding or interlocking panels or sections. In some embodiments, floor tarp 34 may be detachable so it can be hung to dry or washed.

In some embodiments, material or panels may be attachable to the legs to cover the sides of the shelter and create additional protection from the sun, wind, rain, or other elements. The selection of the material for material or panels to cover the sides of the shelter depends on what capabilities are desired for the shelter. If the shelter is also intended to provide a rain shelter, then some type waterproof or water resistant material would be used to cover the sides. Such material could include plastic, Gore-Tex™, rubber based material, water resistant/waterproof nylon, or water resistant/waterproof polyester. If the shelter is intended to serve as shade then the material to cover the sides should be sufficient to block sunlight such as cotton cloth, polyester, or nylon.

If the shelter is intended to provide protection from insects then material to cover the sides should have mesh which is small enough to keep the insects out, such as mosquito netting.

The procedure for collapsing and folding up the shelter is explained with reference to FIGS. 11A-11E (showing a side view for collapsing the gable poles and legs) and 12A-12E (showing a front view for further collapsing the gable poles and collapsing the ridge poles). In operation, to fold up the shelter, the user slides gable strut sleeve 25 off the pivot joint of gable strut 24. The user then pushes pole joints 21A, 21B toward each other causing segments that form the gable strut 24 to pivot, as well as causing the pivot joint connecting the segments to move toward the end panel bottom 17A (or in the opposite direction). The user continues pushing pole joints 21A, 21B toward each other until they are touching or until gable poles 18A, 18B are generally parallel. If a floor tarp 34 is included in the embodiment, it is detached from legs 26A, 26B.

Next, the user removes restraining pins 28. Leg 26A is then pivoted so that its free end moves in an arc toward end panel bottom 17A. Leg 26B is pivoted in the same manner as leg 26A. Ultimately, legs 26A, 26B are pivoted to a position so that they are approximately parallel or their free ends are touching. The same procedure is used to fold the gable strut attached to pole joint 21C and the pole joint 21D (i.e., the pole joint attached to gable pole 18D), gable poles 18C, 18D and legs 26C, 26D together at the other end of the shelter.

Next, the user slides ridge pole strut sleeves 31A, 31B (and the ridge pole strut sleeves slidably located on the ridge pole struts attached to hinge plates 29B, 29D) off of the pivot joints of the ridge pole struts 30A, 30B on which they are located. Pole joints 21A, 21B, 21C and 21D (the pole joint attached to gable pole 18D) are then pushed toward ridge poles 15A, 15B so that they are touching or almost touching ridge poles 15A, 15B.

Shaft pin 12 is removed and central hub top plate 10 is slid away from central hub bottom plate assembly 5. Ridge poles 15A, 15B are pivoted toward each other so that they are parallel or approximately parallel. When completely collapsed and folded, the shelter has the configuration shown in FIG. 13.

The shelter's folded-up position can be maintained by straps that wrap around the legs, ridge poles and/or other portions of the shelter. Clips that secure the legs, ridge poles and/or other portions of the shelter may likewise be used to maintain the shelter in a folded up position.

In embodiments where central hub bottom plate assembly 5 and top plate 10 are slidably mounted on shaft 2, the shaft 2 can be slid down so that less of it protrudes above the top plate 10. This reduces the overall length of the shelter when it is folded up making it more compact. The folded up unit may also be placed in a bag or sleeve to maintain its compactness.

While the invention has been described in detail and with reference to specific embodiments thereof, it will be apparent to one skilled in the art that various changes and modifications can be made therein without departing from the spirit and scope thereof. For example, the shelter and its components may possess any suitable dimensions and shape, and may be formed from any suitable material.

It is to be understood that terms such as "top", "bottom", "front", "rear", "side", "height", "length", "width", "upper", "lower", "interior", "exterior", and the like as may be used herein, merely describe points of reference and do not limit the present invention to any particular orientation or configuration. Thus, it is intended that the present invention covers the modifications and variations of this invention provided they come within the scope of the appended claims and their equivalents.

I claim:

1. A freestanding, collapsible shelter comprising:

a roof structure including:

a roof hub defining a roof hub axis, a first ridge pole having a proximal end pivotally coupled to the roof hub and a distal end, wherein the first ridge pole pivots from a deployed position in which the first ridge pole is oriented generally aligned with the roof hub axis to a stowed position in which the first ridge pole is oriented generally orthogonal to the hub axis, a second ridge pole having a proximal end pivotally coupled to the roof hub and a distal end, wherein the second ridge pole pivots from a deployed position in which the second ridge pole is oriented generally aligned with the roof hub axis to a stowed position in which the second ridge pole is oriented generally orthogonal to the hub axis, a first connection element coupled to the distal end of the first ridge pole, a second connection element coupled to the distal end of the second ridge pole, a first gable pole and a second gable pole each pivotally coupled to the first connection element, wherein the gable poles pivot from a deployed position, in which the first and second gable poles are oriented at an angle with respect to the roof hub axis, to a stowed position, in which the first and second gable poles are oriented generally orthogonal to the roof hub axis, a third gable pole and a fourth gable pole each pivotally coupled to the second connection element, wherein the gable poles pivot from a deployed position, in which the third and fourth gable poles are oriented at an angle with respect to the roof hub axis, to a stowed position, in which the third and fourth gable poles are oriented generally orthogonal to the roof hub axis, a ridge pole strut extending from the first ridge pole to the first gable pole, the ridge pole strut being pivotally coupled to the first ridge pole and the first gable pole; and a freestanding leg section comprising a plurality of leg members operable to support the roof structure over a supporting surface when the shelter is disposed in its deployed position.

2. The shelter of claim 1, wherein, in the deployed position:

the first gable pole and the second gable pole are oriented at one of an obtuse angle and an acute angle with respect to a plane including the roof hub axis; and the third gable pole and the fourth gable pole are oriented at one of an obtuse angle and an acute angle with respect to plane including the roof hub axis.

3. The shelter of claim 2, wherein, in the deployed position:

the plane including the roof hub axis is generally horizontal;

the first gable pole and the second gable pole are each oriented at an acute angle with respect to the plane including the roof hub axis; and the third gable pole and the fourth gable pole are each oriented at an acute angle with respect to the plane including the roof hub axis.

4. The shelter of claim 1, wherein:

the first connection element comprises an upper section hinged to a lower section such that the lower section pivots with respect to the upper section;

the upper section of the first connection element is connected to the distal end of the first ridge pole; and the first and second gable poles are pivotally coupled to the lower section of the first connection element.

5. The shelter of claim 4, wherein:

the second connection element comprises an upper section hinged to a lower section such that the lower section pivots with respect to the upper section, the upper section of the second connection element is connected to the distal end of the second ridge pole, and the third and fourth gable poles are pivotally coupled to the lower section of the second connection element.

6. The shelter of claim 1, wherein the first and second connection elements each includes a pair of angularly spaced flange stops operable to limit pivoting of the gable poles along a plane including the flange stops.

7. The shelter of claim 6, wherein the flange stop prevents the gable poles from pivoting more than 90°.

8. The shelter of claim 1, wherein each of the plurality of leg members are pivotally coupled to a corresponding gable pole via a pole joint.

9. The shelter of claim 8, wherein:

the pole joint comprises an upper portion set at an angle with respect to a lower portion;

the upper portion receives a respective gable pole;

the lower portion receives a respective leg member;

the leg member is pivotally coupled within the lower portion of the pole joint; and the lower portion of the pole joint comprises a wall opening that permits the passage of the leg member and permits the selective pivoting of the leg member into and out of the lower portion.

10. The shelter of claim 1, wherein the roof section further comprises:

a first gable strut extending from the first gable pole to the second gable pole;

a second gable strut extending from the third gable pole to the fourth gable pole;

wherein the gable struts are configured to support and stabilize the gable poles when oriented in their deployed positions.

11. The shelter of claim 1, wherein:

the roof hub comprises:

a bottom plate assembly, and a top plate disposed over and separable from the bottom plate assembly; and the roof hub defines a channel aligned with the roof hub axis, and wherein both the first and second ridge poles are partially received in the roof hub channel.

12. The shelter of claim 11, wherein the roof hub further comprises a shaft oriented generally perpendicular to the roof hub axis, wherein at least one of the bottom plate assembly and the top plate is adapted to slide along the shaft.

13. The shelter of claim 12, wherein the roof hub permits the pivoting of the ridge poles from the deployed position to the stowed position when the top plate is disposed in spaced relation from the bottom plate assembly.

14. The shelter of claim 11, wherein:

the each ridge pole comprises a pole butt disposed at the proximal end; and the pole butt comprises an enlarged pole section having an angled or rounded terminal end.

15. The shelter of claim 1, wherein the roof structure defines a gabled roof.

16. The shelter of claim 1, further comprising a canopy coupled to the roof structure.

17. The shelter of claim 1, wherein:

the ridge pole strut comprises a first ridge pole strut; and the roof structure further includes a second ridge pole strut extending from the second ridge pole to the third gable pole, the second ridge pole strut being pivotally coupled to the second ridge pole.

18. The shelter of claim 17, wherein:

the first ridge pole strut comprises:

a proximal end pivotally coupled to the first ridge pole, and a distal end pivotally coupled to the first gable pole; and the second ridge pole strut comprises:

a proximal end pivotally coupled to the second ridge pole, and a distal end pivotally coupled to the first gable pole.

19. The shelter of claim 1, wherein the ridge pole strut comprises a first segment and a second segment pivotally coupled to the first segment.

20. The shelter of claim 19, wherein each ridge pole strut further comprises a strut sleeve adapted to slide along the ridge pole strut.

21. The shelter of claim 1, wherein the ridge pole strut is hinged to the first ridge pole via a hinge plate.

22. The shelter of claim 1, wherein:

the ridge pole strut comprises a first ridge pole strut; and the roof structure further comprises:

a second ridge pole strut extending from the first ridge pole to the second gable pole, the second ridge pole strut being pivotally coupled to the first ridge pole, a third ridge pole strut extending from the second ridge pole to the third gable pole, the third ridge pole strut being pivotally coupled to the second ridge pole, and a fourth ridge pole strut extending from the second ridge pole to the fourth gable pole, the fourth ridge pole strut being pivotally coupled to the second ridge pole.

23. The shelter of claim 22, wherein each ridge pole strut comprises:

a proximal end coupled to a corresponding ridge pole and a distal end coupled to a corresponding gable pole; and a first segment pivotally coupled to a second segment.

24. A method of folding a freestanding, collapsible shelter from a deployed configuration to a stowed configuration, the method comprising:

(a) obtaining a freestanding, collapsible shelter comprising:

a roof structure including:

a roof hub defining a roof hub axis, a first ridge pole having a proximal end pivotally coupled to the roof hub and a distal end, wherein the first ridge pole pivots from a deployed position, in which the first ridge pole is generally aligned with the roof hub axis, to a stowed position, in which the first ridge pole is oriented generally orthogonal to the roof hub axis, a second ridge pole having a proximal end pivotally coupled to the roof hub and a distal end, wherein the second ridge pole pivots from a deployed position, in which the second ridge pole is generally aligned with the roof hub axis, to a stowed position, in which the second ridge pole is oriented generally orthogonal to the roof hub axis, a first connection element coupled to the distal end of the first ridge pole, a second connection element coupled to the distal end of the second ridge pole, a first gable pole and a second gable pole each pivotally coupled to the first connection element, wherein the first and second gable poles pivot from a deployed position, in which the first and second gable poles are oriented at an angle with respect to the roof hub axis, to a stowed position, in which the first and second gable poles are oriented generally orthogonal to the roof hub axis, a third gable pole and a fourth gable pole pivotally coupled to the second connection element, wherein the third and fourth gable poles pivot from a deployed position, in which the third and fourth gable poles are oriented at an angle with respect to the roof hub axis, to a stowed position, in which the third and fourth gable poles are oriented generally orthogonal to the roof hub axis, and a ridge pole strut extending from the first ridge pole to the first gable pole, the ridge pole strut being pivotally coupled to the first ridge pole and the first gable pole; and a freestanding leg section comprising a plurality of leg members operable to support the roof structure over a surface when the shelter is disposed in its deployed position;

(b) pivoting the first and second gable poles from their deployed position to their stowed position;

(c) pivoting the third and fourth gable poles from their deployed position to their stowed position; and (d) folding the first and second ridge poles from their deployed position to their stowed position.

25. The method of claim 24, wherein:

the first connection element comprises an upper section hinged to a lower section such that the lower section pivots with respect to the upper section;

the upper section of the first connection element is connected to the distal end of the first ridge pole;

the first and second gable poles are pivotally coupled to the lower section of the first connection element;

the second connection element comprises an upper section hinged to a lower section such that the lower section pivots with respect to the upper section;

the upper section of the second connection element is connected to the distal end of the second ridge pole;

the third and fourth gable poles are pivotally coupled to the lower section of the second connection element; and the method further comprises:

(e) pivoting the first and second gable poles such that they are generally parallel, (f) pivoting the lower section of the first connection element to position the first and second gable poles along a plane oriented generally parallel to the roof hub axis, (g) pivoting the third and fourth gable poles such that they are generally parallel, and (h) pivoting the lower section of the second connection element to position the third and fourth gable poles along a plane oriented generally parallel to the roof hub axis.

26. The method of claim 24, wherein:

the roof hub comprises:

a bottom plate assembly;

a top plate disposed over and separable from the bottom plate assembly, and a channel aligned with the roof hub axis, and wherein both the first and second ridge poles are partially received in the roof hub channel; and the method comprises:

(e) separating the top plate from the bottom plate assembly, and (f) pivoting the first and second ridge poles from a deployed position, in which the proximal end of the poles are housed within the channel, to a stowed position, in which the proximal ends of the ridge poles are removed from the channel.

* * * * *